US008676084B2

(12) United States Patent
Maeda

(10) Patent No.: US 8,676,084 B2
(45) Date of Patent: Mar. 18, 2014

(54) CLEANING DEVICE, IMAGE FORMING APPARATUS, AND CLEANING METHOD

(75) Inventor: Naoya Maeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 268 days.

(21) Appl. No.: 13/040,818

(22) Filed: Mar. 4, 2011

(65) Prior Publication Data

US 2012/0057896 A1 Mar. 8, 2012

(30) Foreign Application Priority Data

Sep. 3, 2010 (JP) ..... 2010-198363

(51) Int. Cl.
*G03G 21/00* (2006.01)

(52) U.S. Cl.
USPC ..... 399/102; 399/103

(58) Field of Classification Search
USPC ..... 399/102, 103, 99
See application file for complete search history.

(56) References Cited

U.S. PATENT DOCUMENTS 6,591,074 B1 * 7/2003 Michlin ..... 399/106
7,711,288 B2 * 5/2010 Saiki et al. ..... 399/120
8,320,792 B2 * 11/2012 Kawakami et al. ..... 399/102

FOREIGN PATENT DOCUMENTS

JP 01-312580 A 12/1989
JP 08-314348 A 11/1996

* cited by examiner

*Primary Examiner* — David Gray
*Assistant Examiner* — Michael Harrison
(74) *Attorney, Agent, or Firm* — Sughrue Mion, PLLC

(57) ABSTRACT

A cleaning device includes a cleaning member that cleans a surface of an image carrier by removing developer from the surface of the image carrier, the developer remaining on the surface of the image carrier instead of being transferred onto a transfer body; a housing that receives the developer removed by the cleaning member; a transporting member provided in the housing, the transporting member transporting the developer toward an end of the image carrier in a rotational axis direction; a first sealing member that fills a gap between the image carrier and the housing at an upstream side in a transporting direction of the developer; and a second sealing member that fills a gap between the image carrier and the housing at a downstream side in the transporting direction of the developer, the second sealing member having a denser structure than the structure of the first sealing member.

15 Claims, 7 Drawing Sheets

CLEANING DEVICE, IMAGE FORMING APPARATUS, AND CLEANING METHOD

CROSS-REFERENCE TO RELATED APPLICATIONS

This application is based on and claims priority under 35 USC 119 from Japanese Patent Application No. 2010-198363 filed Sep. 3, 2010.

BACKGROUND

The present invention relates to a cleaning device, an image forming apparatus, and a cleaning method.

SUMMARY

According to an aspect of the invention, there is provided a cleaning device including a cleaning member that cleans a surface of a rotating image carrier by removing developer from the surface of the image carrier, the developer remaining on the surface of the image carrier instead of being transferred onto a transfer body; a housing that receives the developer removed by the cleaning member; a transporting member provided in the housing, the transporting member transporting the developer toward an end of the image carrier in a rotational axis direction; a first sealing member that fills a gap between the image carrier and the housing at an upstream side in a transporting direction of the developer; and a second sealing member that fills a gap between the image carrier and the housing at a downstream side in the transporting direction of the developer, the second sealing member having a denser structure than the structure of the first sealing member.

BRIEF DESCRIPTION OF THE DRAWINGS

An exemplary embodiment of the present invention will be described in detail based on the following figures, wherein.

DETAILED DESCRIPTION

Figure 1:
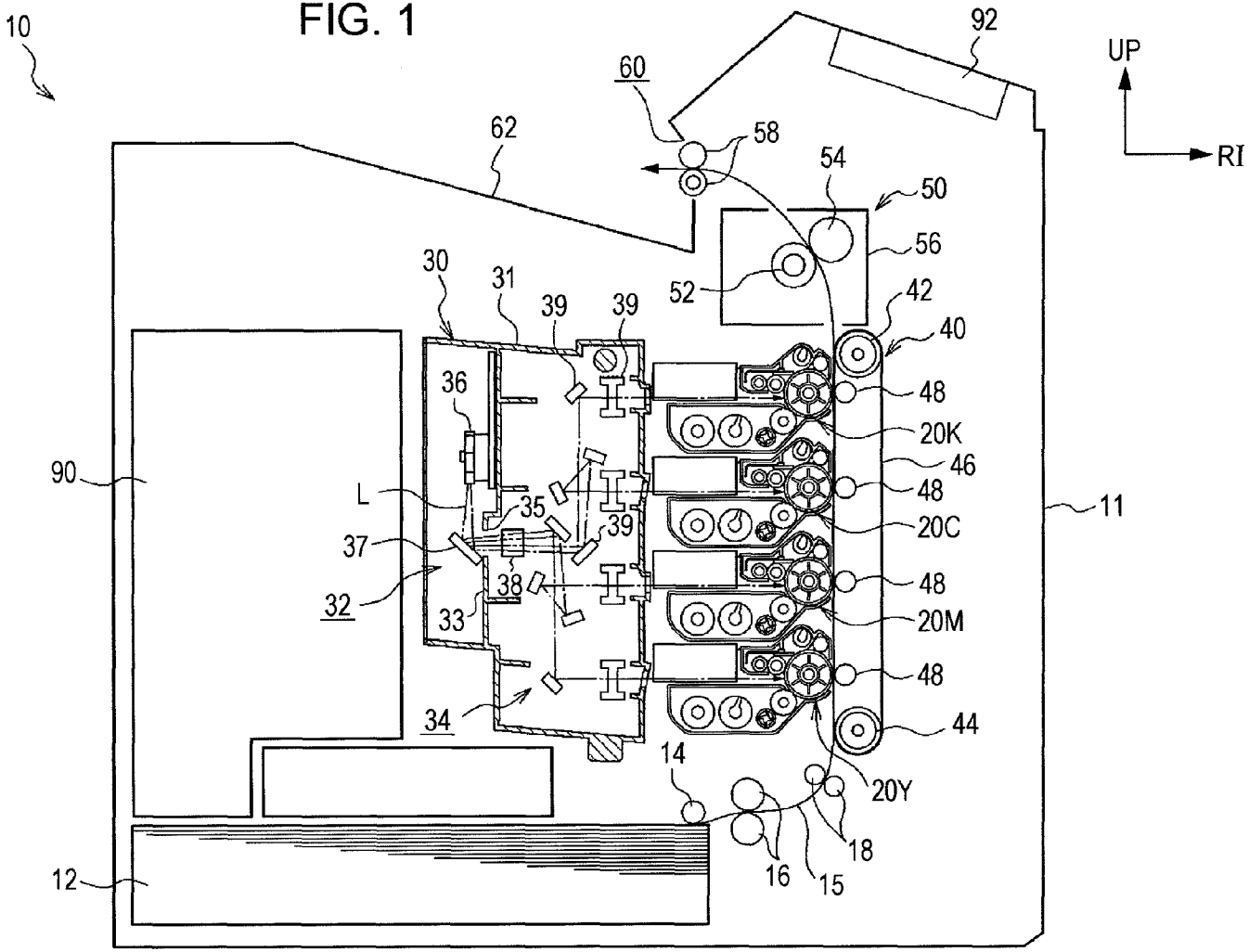
FIG. 1 illustrates the structure of an image forming apparatus.

An exemplary embodiment of the present invention will be described with reference to the accompanying drawings. In FIG. 1, the arrow "UP" indicates the upper side of an image forming apparatus 10, and the arrow "RI" indicates the right side of the image forming apparatus 10. In addition, the side visible in FIG. 1 is defined as the front side of the image forming apparatus 10. In the present exemplary embodiment, a recording sheet P is described as an example of a transfer body. An upstream side and a downstream side in a transporting direction of the recording sheet P is sometimes referred to simply as "upstream side" and "downstream side", respectively.

Referring to FIG. 1, image forming units 20Y, 20M, 20C, and 20K, which are an example of image forming members, are arranged in the vertical direction in a housing 11 of the image forming apparatus 10. The image forming units 20Y to 20K form images with toners (developers) of respective colors, which are yellow (Y), magenta (M), cyan (C), and black (K), respectively. The image forming units 20Y, 20M, 20C, and 20K are arranged in that order from the lower side of the image forming apparatus 10 (upstream side of a sheet transport path 15) toward the upper side of the image forming apparatus 10 (downstream side of the sheet transport path 15).

The image forming units 20Y to 20K have similar structures except that different types of toners are stored in developing units 24, which will be described below. In the following description, the letters 'Y', 'M', 'C', and 'K' are attached to reference numerals denoting components corresponding to yellow (Y), magenta (M), cyan (C), and black (K) when they are to be distinguished from each other. The letters 'Y', 'M', 'C', and 'K' are omitted when it is not necessary to distinguish the components corresponding to the respective colors. The manufacturing methods of the toners of 'Y', 'M', 'C', and 'K' are not particularly limited.

Referring to FIG. 1, a sheet feeding unit 12 in which recording sheets P are stored is disposed at a lower section of the housing 11. A sending-out roller 14 that sends out the recording sheets P is disposed above the sheet feeding unit 12. Transporting rollers 16, which are a pair of rollers that transport a recording sheet P, and positioning rollers 18, which are a pair of rollers that adjust the time at which the recording sheet P that has been transported by the transporting rollers 16 is further transported, are disposed downstream of the sending-out roller 14. The sheet transport path 15 includes the transporting rollers 16 and the positioning rollers 18.

A transporting unit 40 is disposed in the right section of the housing 11 in FIG. 1 (at the position where the transporting unit 40 is opposed to photoconductors 26 (described below), which are an example of image carriers). The transporting unit 40 is disposed adjacent to the image forming units 20Y to 20K and transports the recording sheet P successively to the image forming units 20Y to 20K.

The transporting unit 40 includes a drive roller 42, a driven roller 44, and a transporting belt 46. The drive roller 42 and the driven roller 44 are arranged vertically along a side wall (right side wall in FIG. 1) of the housing 11. The transporting belt 46 is stretched around the drive roller 42 and the driven roller 44, and is rotated when the drive roller 42 is rotated by a motor (not shown). Although not illustrated, an absorption roller that causes the recording sheet P to be electrostatically attracted to the transporting belt 46 when a voltage is applied to the absorption roller is opposed to the driven roller 44 with the transporting belt 46 interposed therebetween.

Transfer rollers 48 are disposed inside the transporting belt 46 such that the transfer rollers 48 are opposed to the photoconductors 26 of the respective colors. A voltage is applied to the transfer rollers 48 by a voltage applying unit (not shown) so that toner images formed on the photoconductors 26 are transferred onto the recording sheet P while the recording sheet P is being transported by the transporting belt 46. A fixing unit 50 is disposed downstream of the transporting unit 40 and above the image forming unit 20K. The fixing unit 50 is an example of a fixing member that fixes the toner images that have been transferred onto the recording sheet P to the recording sheet P.

The fixing unit 50 includes a heating roller 52 that heats and melts the toner included in the toner images that have been transferred onto the recording sheet P, a pressing roller 54 that is in contact with the outer peripheral surface of the heating roller 52 and presses the outer peripheral surface of the heating roller 52, and a cover member 56 that covers the heating roller 52 and the pressing roller 54.

The heating roller 52 includes, for example, a cylindrical core bar (not shown) made of aluminum and coated with silicone rubber and fluorocarbon resin and a halogen heater (not shown) placed in the core bar as an example of a heat source. The heating roller 52 heats and melts the toner when the halogen heater generates heat under the control of a controller 90, which will be described below.

The pressing roller 54 includes, for example, a cylindrical core bar (not shown) made of aluminum fluorocarbon resin and coated with silicone rubber, and is pressed against the outer peripheral surface of the heating roller 52 by being urged by a spring (not shown). Ejection rollers 58, which are a pair of rollers, are disposed downstream of the fixing unit 50.

An ejection opening 60 through which the recording sheet P is ejected and a sheet output unit 62 on which the recording sheet P ejected through the ejection opening 60 is placed are provided in the upper section of the housing 11. The ejection rollers 58 are arranged so as to block the ejection opening 60. The recording sheet P to which the toner images are fixed by the fixing unit 50 is ejected through the ejection rollers 58 and placed on the sheet output unit 62.

An optical scanning unit 30 is disposed on the left side of the image forming units 20 in FIG. 1 in the housing 11. The optical scanning unit 30 irradiates the photoconductors 26 that are rotatably arranged in the image forming units 20 with exposure light L. The optical scanning unit 30 includes a housing 31, which is sectioned into an optical scanning section 32 (left side in FIG. 1) and a light guide section 34 (right side in FIG. 1) by a separation wall 33 that extends vertically. The separation wall 33 has an opening 35 through which light is guided from the optical scanning section 32 to the light guide section 34.

The optical scanning section 32 includes a light emitting member (for example, a semiconductor laser) that emits exposure light L corresponding to each color; a polygon mirror (rotating polygon) 36 that is rotated by a motor (not shown) so as to deflect the exposure light L in a first scanning direction of the recording sheet P; and a reflecting mirror 37 that reflects the exposure light L deflected by the polygon mirror 36 toward the opening 35.

The light guide section 34 includes a lens 38 disposed near the opening 35 and plural optical components (reflecting mirrors and lenses) 39 that guide the exposure light L that has passed through the lens 38 toward the photoconductors 26 in the image forming units 20Y to 20K. In FIG. 1, only the optical components on the optical path of the exposure light L guided to the image forming unit 20K are denoted by reference numeral 39, and the reference numeral is omitted for the other optical components. The surface (outer peripheral surface) of each photoconductor 26 is irradiated with the exposure light L, so that an electrostatic latent image corresponding to image information is formed on the surface of each photoconductor 26.

The controller 90, which controls the operation of each part of the image forming apparatus 10, is provided next to the optical scanning unit 30 (on the left side in FIG. 1) in the housing 11. An operation panel 92 is disposed above the fixing unit 50 in the housing 11 in such a state that the upper surface of the operation panel 92 is exposed. The operation panel 92 is an example of an operation unit that is operated by an operator to activate each part of the image forming apparatus 10 or to input various settings (number of pages, image density, etc.).

Figure 3:
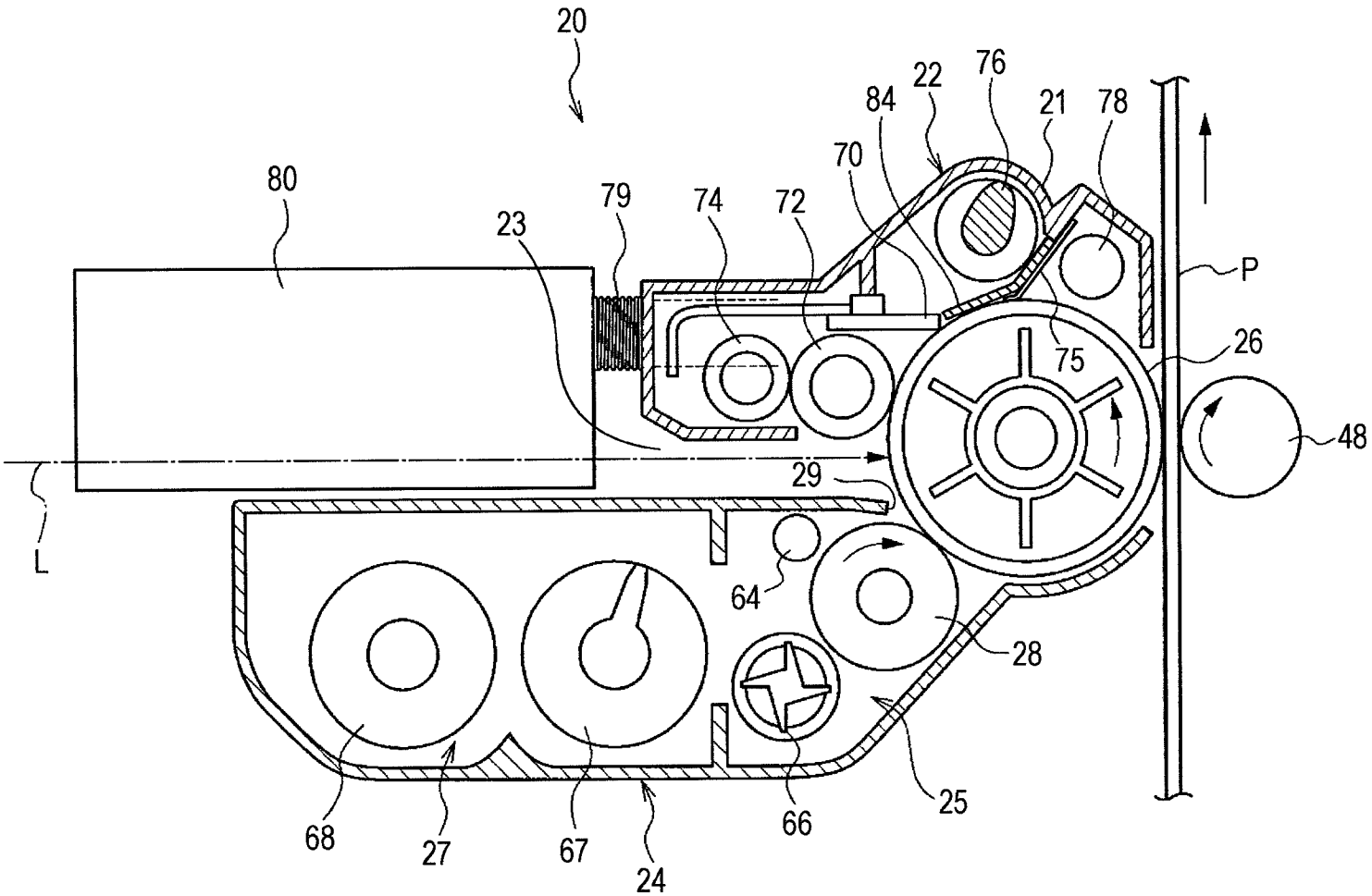
FIG. 3 illustrates the structure of an image forming unit.

Referring to FIG. 3, each image forming unit 20 includes a photoconductor unit 22 disposed at an upper section and a developing unit 24 disposed at a lower section. The photoconductor unit 22 includes the photoconductor 26. The developing unit 24 contains the toner of each color and develops the electrostatic latent image formed on the photoconductor 26 with the toner. An optical path 23 through which the exposure light L passes is formed between the photoconductor unit 22 and the developing unit 24. The surface of the photoconductor 26 is irradiated with the exposure light L that passes through the optical path 23.

The developing unit 24 includes a developing section 25 that visualizes the electrostatic latent image formed on the photoconductor 26 with the toner and a tonner supplying section 27 that supplies the toner to the developing section 25. The developing section 25 and the tonner supplying section 27 are integrated with each other along the horizontal direction in FIG. 3. The developing section 25 has an opening 29 at a position near the photoconductor 26, and a developing roller 28 is disposed such that the peripheral surface thereof is partially exposed at the opening 29. In the present exemplary embodiment, two-component developer including carrier composed of metal particles and toner composed of resin particles will be explained as an example of the developer. However, the developer is not limited to this, and one-component developer including only toner may be used instead.

The developing roller 28 includes a nonmagnetic cylindrical developing sleeve (not shown) which is rotatable in the direction shown by the arrow (clockwise in FIG. 3) and a magnetic roller (not shown) which is fixed to the inner periphery of the developing sleeve and in which magnetic poles of different polarities are alternately arranged. A gear (not shown) is fixed to an end of the developing sleeve in the axial direction thereof. A rotational driving force is transmitted from a motor to the gear, so that the developing sleeve is rotated by the rotation of the gear.

The developing roller 28 attracts the carrier included in the developer with magnetic force, and thereby forms a magnetic brush of the developer on the surface thereof. Accordingly, the toner carried by the carrier is transported to a developing area (developer supplying position) (not shown) in which the developing roller 28 is opposed to the photoconductor 26. Then, the electrostatic latent image formed on the photoconductor 26 by the exposure light L is visualized by the magnetic brush of the developer formed on the surface of the developing roller 28.

A cylindrical layer-thickness regulating member 64 is opposed to the outer peripheral surface of the developing roller 28 at a position upstream of the developing area in the direction in which the developing roller 28 rotates. The layer-thickness regulating member 64 is formed of, for example, aluminum, and regulates the layer thickness of the developer supplied to the developing roller 28.

A first stirring member 66 is rotatably supported below the developing roller 28. The first stirring member 66 has a helical shape, and transports the toner (and the carrier) in the same direction as the axial direction of the developing roller 28 while stirring the toner. A gear (not shown) is fixed to an end of the first stirring member 66, and the first stirring member 66 is rotated when a rotational driving force is transmitted from a motor (not shown) to the gear.

The toner is transported to the outer peripheral surface of the developing roller 28 while being stirred by the rotation of the first stirring member 66. A second stirring member 67 and a third stirring member 68 are rotatably provided in the tonner supplying section 27 that is adjacent to the developing section 25. The second and third stirring members 67 and 68 have a helical shape, and the axial direction thereof coincides with the axial direction of the developing roller 28. The toner is stirred and circulated by the second and third stirring members 67 and 68.

The photoconductor unit 22 includes the photoconductor 26, a charging roller 72, a cleaning roller 74, a cleaning blade 70, a screw auger 76, and an erase lamp 78. The photoconductor 26 is rotatably supported at the ends thereof by bearings (not shown) provided in the housing 21. The charging roller 72 is opposed to the surface (outer peripheral surface) of the photoconductor 26 and charges the surface of the photoconductor 26 by using a potential difference. The cleaning roller 74 cleans the outer peripheral surface of the charging roller 72. The cleaning blade 70 is an example of a cleaning member which cleans the surface of the photoconductor 26 by removing residual toner (hereinafter referred to as "waste toner") that remains on the surface of the photoconductor 26. The screw auger 76 is an example of a (first) transporting member that transports the waste toner removed by the cleaning blade 70 and stored in the housing 21 toward a first end of the photoconductor 26 in the rotational axis direction thereof. The erase lamp 78 eliminates the electric charge on the surface of the photoconductor 26 after the transfer process.

As illustrated in FIG. 3, the screw auger 76 is disposed above the photoconductor 26 in the direction of gravity, and is rotated by a motor (not shown). One long side (base end) of a rectangular shield member 75 is attached to a portion of the housing 21 between the screw auger 76 and the erase lamp 78, the longitudinal direction of the shield member 75 coinciding with the rotational axis direction of the photoconductor 26. The other long side (free end) of the shield member 75 is in contact (slidable contact) with the surface of the photoconductor 26.

The shield member 75 prevents or inhibits the waste toner transported by the screw auger 76 from moving toward the erase lamp 78 or falling onto the surface (outer peripheral surface) of the photoconductor 26. The shield member 75 is, for example, film-shaped and is formed of an elastic body so that the shield member 75 does not damage the surface of the photoconductor 26.

Figure 5:
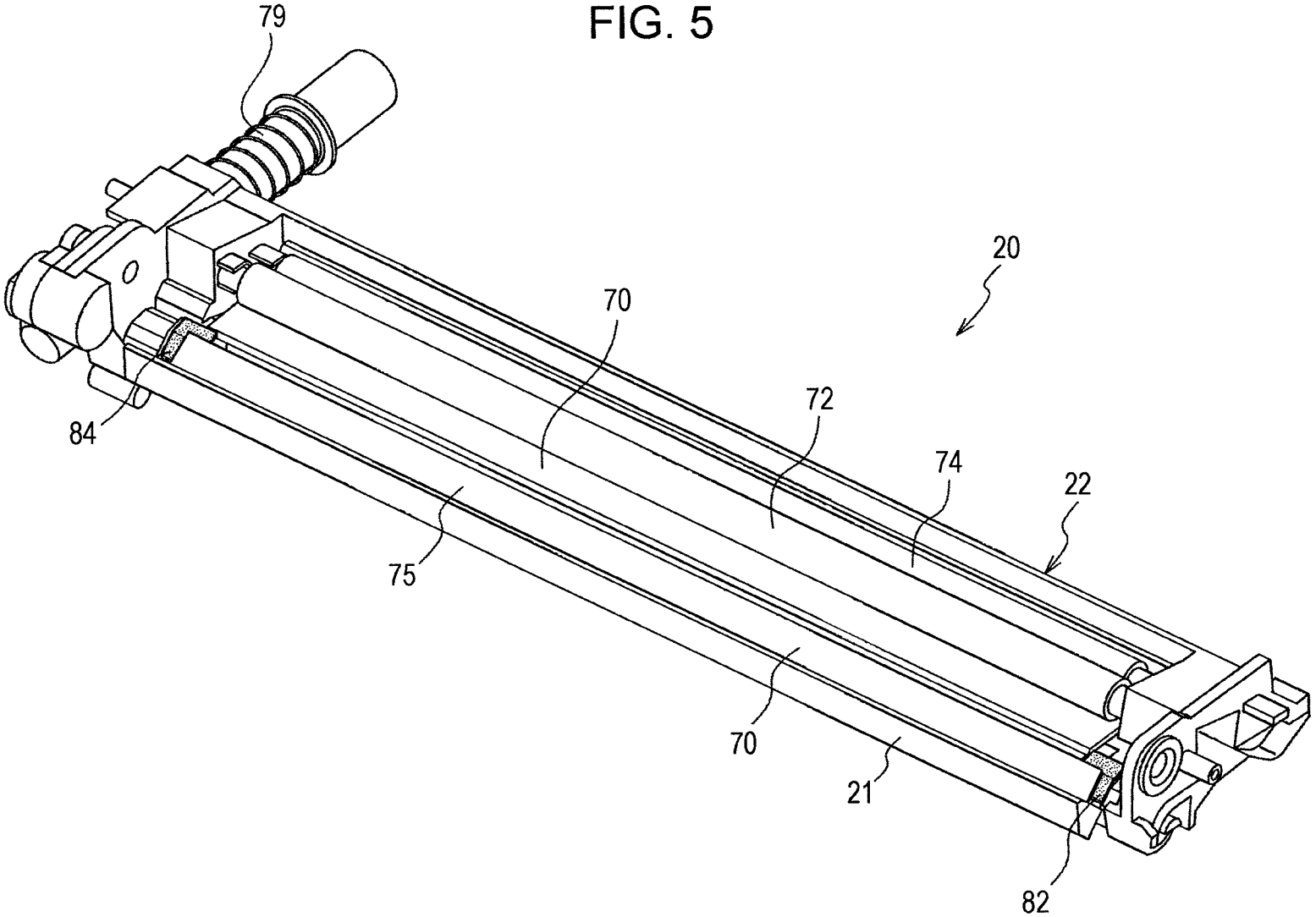
FIG. 5 is a perspective view of the sealing member and other components arranged on the image forming unit.

Referring to FIG. 5, the shield member 75 is arranged such that end portions thereof overlap sealing members 82 and 84, which will be described below. End portions of the photoconductor 26 press the sealing members 82 and 84 with the end portions of the shield member 75 interposed between the photoconductor 26 and the sealing members 82 and 84.

Figure 6:
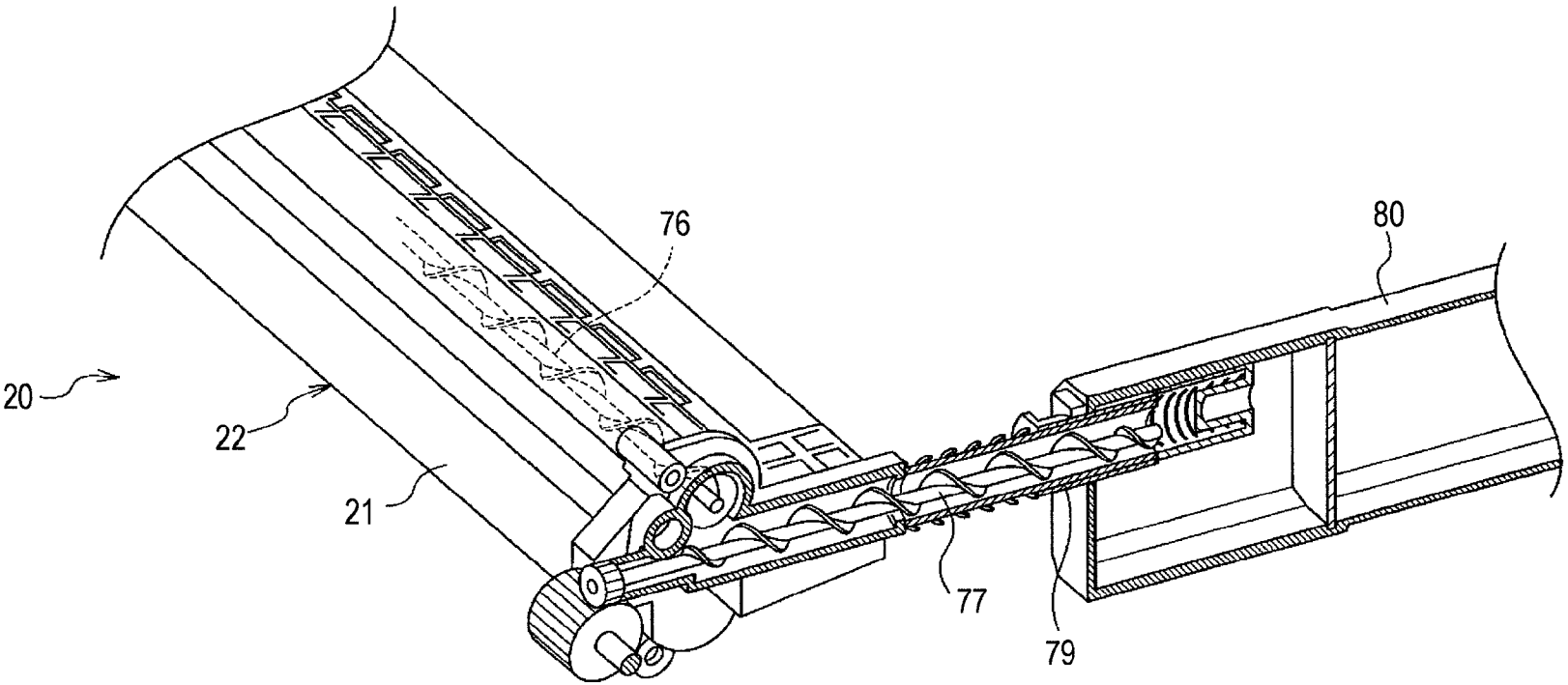
FIG. 6 is a perspective sectional view illustrating the structure for transporting waste toner to a collection container.

Referring to FIG. 6, a screw auger 77 is provided on the housing 21. The screw auger 77 is an example of a (second) transporting member for guiding the waste toner that has been transported by the screw auger 76 to a collection container 80, which will be described below. The screw auger 77 crosses a transporting direction in which the screw auger 76 transports the waste toner at, for example, substantially 90 degrees and extends nearly horizontally (such that a transport path of the waste toner at the downstream side in the transporting direction of the waste toner crosses the transporting direction.

More specifically, a first end of a cylindrical member 79 that houses the screw auger 77 is integrally attached to a first end of the housing 21 at the downstream side in the transporting direction of the waste toner such that the waste toner may be transported from the screw auger 76 to the screw auger 77. The housing 21 (the screw auger 76) and the cylindrical member 79 (the screw auger 77) are arranged so as to form an 'L' shape in plan view.

The screw auger 77 is also rotated by a motor (not shown). The screw augers 76 and 77 are preferably rotated by a single common motor. Referring to FIG. 6, the screw augers 76 and 77 are structured such that helical blades are formed on the outer peripheral surfaces of shafts.

Figure 4:
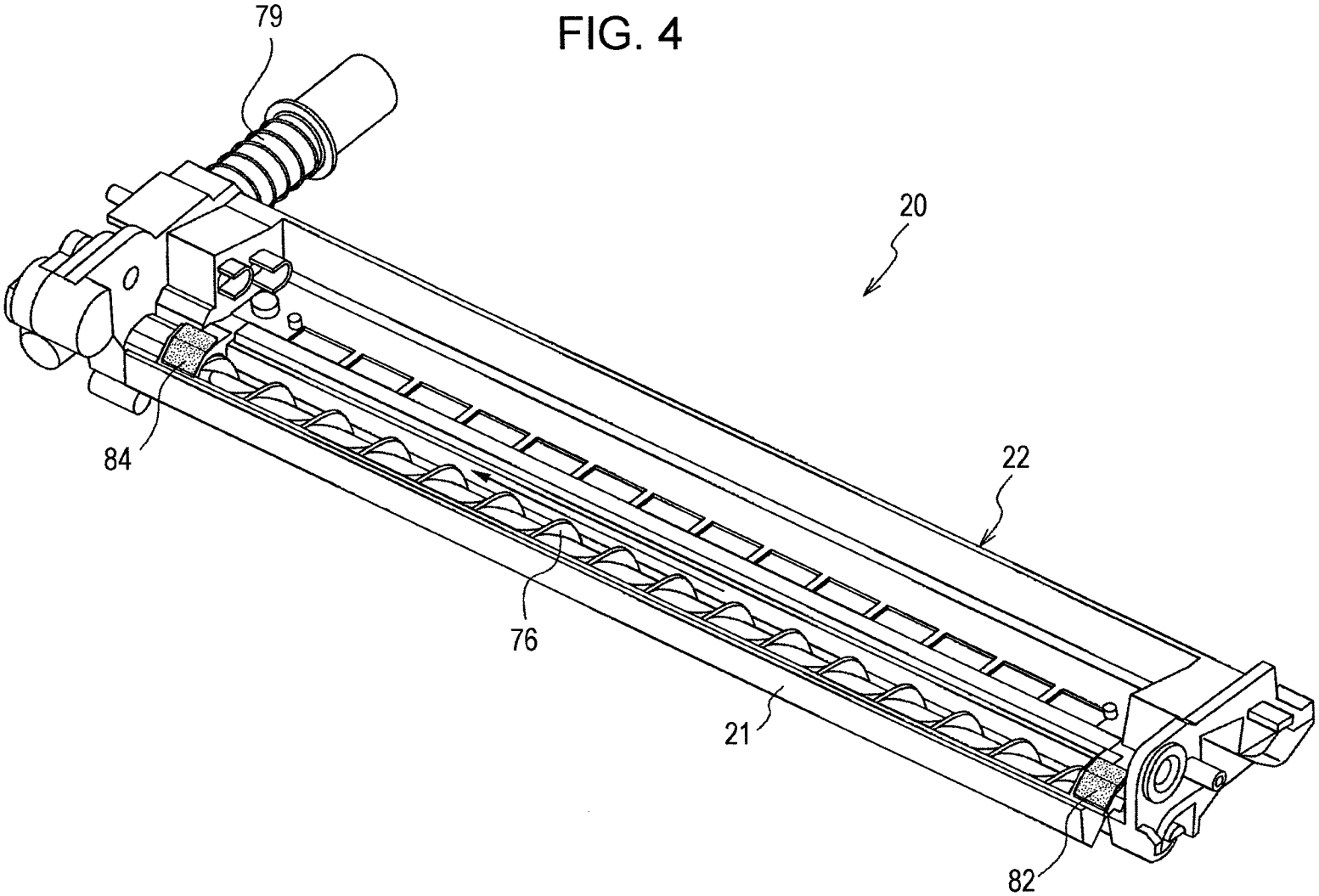
FIG. 4 is a perspective view of a sealing member and other components arranged in the image forming unit.

Referring to FIGS. 4 to 6, the collection container 80 in which the waste toner is collected has a rectangular parallelepiped shape whose longitudinal direction coincides with the axial direction of the cylindrical member 79 (direction in which the screw auger 77 extends). The collection container 80 is detachably attached to a second end of the cylindrical member 79.

Figure 2:
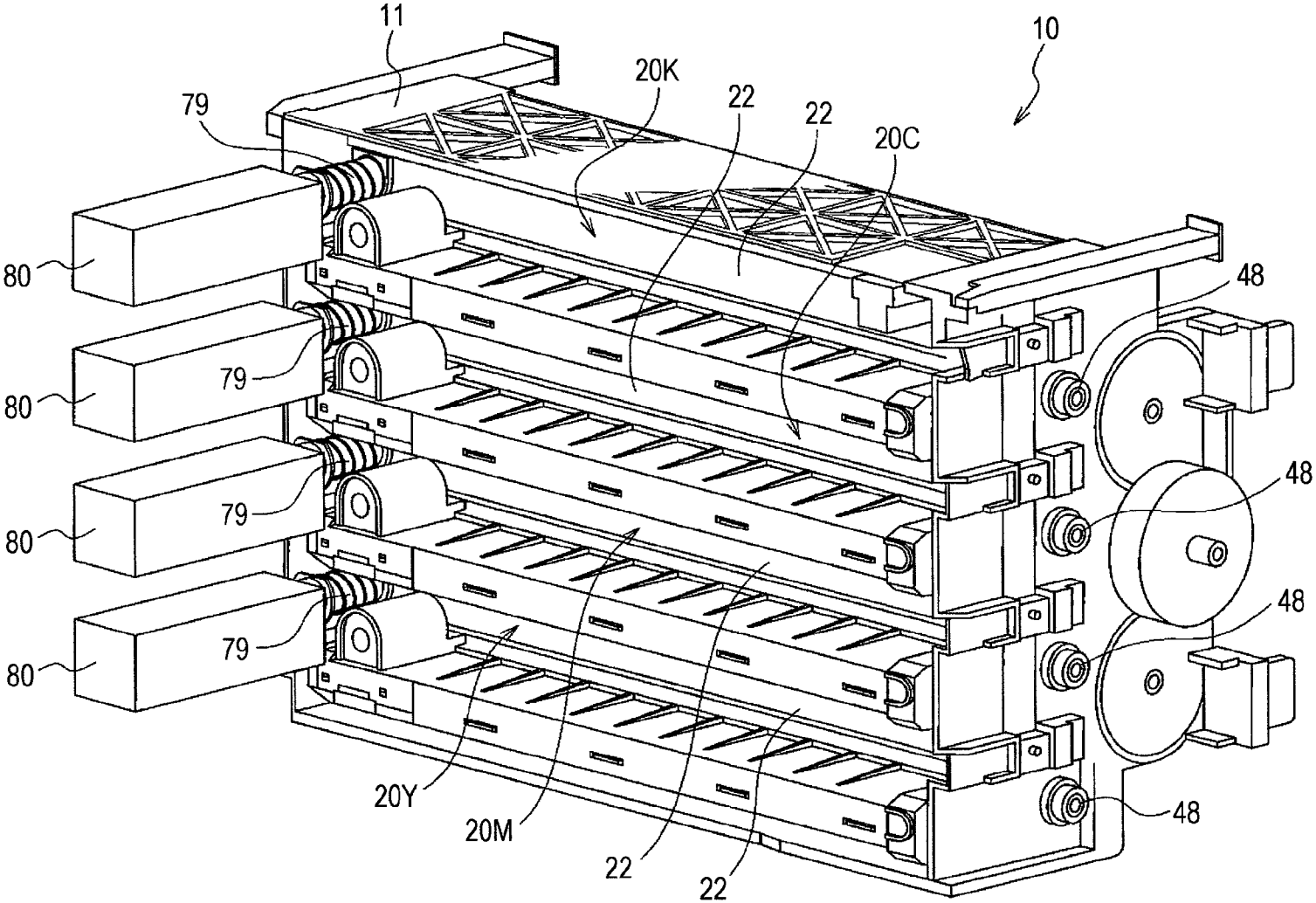
FIG. 2 is a perspective view of image forming units and collection containers for collecting waste toner.

The collection container 80 is replaced with a new collection container when the amount of waste toner collected therein exceeds a predetermined amount. As illustrated in FIG. 2, the collection container 80 is provided for each of the image forming units 20Y to 20K, so that the waste toners of the respective colors do not mix with each other.

Referring to FIGS. 4 and 5, the sealing member 82, which is an example of a first sealing member, is provided between a second end of the housing 21 at the upstream side in the transporting direction of the waste toner and a second end of the photoconductor 26 in the rotational axis direction thereof. A gap between the second end of the housing 21 and the second end of the photoconductor 26 (gap in the transport path of the waste toner) is filled (sealed) with the sealing member 82.

Similarly, the sealing member 84, which is an example of a second sealing member, is provided between the first end of the housing 21 at the downstream side in the transporting direction of the waste toner and the first end of the photoconductor 26 in the rotational axis direction thereof. A gap between the first end of the housing 21 and the first end of the photoconductor 26 (gap in the transport path of the waste toner) is filled (sealed) with the sealing member 84.

Figure 7:
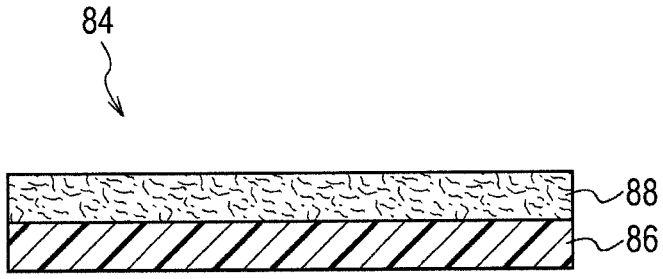
FIG. 7 is a sectional view illustrating the structure of the sealing member disposed at a downstream side in the transporting direction of the waste toner.

The sealing member 82 has a single-layer structure made of urethane foam (sponge). In contrast, as illustrated in FIG. 7, the sealing member 84 has a two-layer structure including a layer of urethane foam 86 and a layer of glass fiber (GF) felt 88, which is a material that is denser than urethane foam 86.

The term "fine" has various meanings, such as delicate, having a high surface density, and having a high elastic modulus. In this specification, it means that the sealing performance is higher than that of urethane foam 86. The sealing members 82 and 84 have the same thickness, and are deformed by the same amount when they are pressed by the end portions of the photoconductor 26 with the shield member 75 interposed between the photoconductor 26 and the sealing members 82 and 84. The sealing member 84 is positioned such that the layer of GF felt 88 faces the photoconductor 26.

The sealing members 82 and 84 at the upstream side and the downstream side, respectively, in the transporting direction of the waste toner have different structures (different materials) for the following reason. That is, the stress applied by the screw auger 76 at the downstream side in the transporting direction of the waste toner is larger than that applied by the screw auger 76 at the upstream side, and the waste toner that has been transported easily accumulates at the downstream side. When the waste toner accumulates in a certain section, there is a high possibility that the waste toner will fall through a gap in that section. This is the reason why the sealing member 84 at the downstream side in the transporting direction of the waste toner is structured so as to provide a high sealing performance (tightness).

A feeder unit (not shown) is disposed at the second end of the housing 21 at the upstream side in the transporting direction of the waste toner. Accordingly, the feeder unit is prevented from being contaminated by the waste toner. The cleaning member for cleaning the surface of the photoconductor 26 is not limited to the illustrated cleaning blade 70, and may instead be, for example, a brush.

The operation of the cleaning device and the image forming apparatus 10 having the above-described structure will now be explained. First, an image forming process of the image forming apparatus 10 will be explained. Referring to FIG. 1, when the units of the image forming apparatus 10 are activated, the image data subjected to image processing performed by the controller 90 is converted into color gradation data for each color and is successively output to the optical scanning unit 30.

The optical scanning unit 30 emits the exposure light L in accordance with the color gradation data of the respective colors, and scans the surface (outer peripheral surface) of each photoconductor 26 that has been charged by the corresponding charging roller 72 with the exposure light L. Thus, an electrostatic latent image is formed on the surface of each photoconductor 26. The electrostatic latent images formed on the surfaces of the photoconductors 26 are developed (visualized) by the developing rollers 28 as toner images (developer images) of respective colors, which are yellow (Y), magenta (M), cyan (C), and black (K).

Next, the toner images of the respective colors that have been successively formed on the photoconductors 26 in the image forming units 20Y, 20M, 20C, and 20K are successively transferred by the transfer rollers 48 onto the recording sheet P that has been transported from the sheet feeding unit 12. The recording sheet P onto which the toner images have been transferred is transported toward the fixing unit 50 by the transporting unit 40.

In the fixing unit 50, the toner images of the respective colors on the recording sheet P are fixed to the recording sheet P by being heated and pressurized by the heating roller 52 and the pressing roller 54. Then, the recording sheet P to which the toner images are fixed is ejected toward the sheet output unit 62 by the ejection rollers 58.

Next, the operation of the cleaning device (photoconductor unit 22) in each image forming unit 20 will be described. The waste toner that remains on the surface of the photoconductor 26 instead of being transferred onto the recording sheet P is scraped off the surface of the photoconductor 26 by the cleaning blade 70 and is collected in the housing 21. Then, the waste toner is transported by the screw auger 76 in a direction from the second end to the first end of the housing 21 (from the side visible in FIG. 3 to the side opposite thereto).

At this time, the shield member 75 inhibits the waste toner from moving toward the erase lamp 78 or falling onto the surface of the photoconductor 26, and the sealing members 82 and 84 prevent the waste toner from falling out of the housing 21 through the gaps between the end portions of the housing 21 and the end portions of the photoconductor 26.

In particular, the sealing member 84 at the downstream side in the transporting direction of the waste toner has a higher sealing performance (tightness) for sealing the end portion of the photoconductor 26 than that of the sealing member 82 at the upstream side in the transporting direction of the waste toner. Therefore, even when the waste toner accumulates in a section where the toner is transported from the screw auger 76 to the screw auger 77, the waste toner is prevented from passing through the gap between the shield member 75 and the sealing member 84 and falling out of the housing 21.

More specifically, the screw auger 76 is disposed above the photoconductor 26 in the direction of gravity, and the screw augers 76 and 77 extend nearly horizontally and cross each other at substantially 90 degrees. In other words, the screw augers 76 and 77 are arranged in an 'L' shape in plan view. A delivery section in which the waste toner is delivered from the screw auger 76 to the screw auger 77 receives stress from the waste toner (the waste toner easily accumulates and falls out).

Moreover, the screw auger 77 transfers the waste toner nearly horizontally to collect the waste toner in the collection container 80. Therefore, compared to the structure in which the waste toner is collected in the collection container 80 by using the force of gravity, the above-described delivery section receives a larger stress from the waste toner (the waste toner more easily accumulates and falls out).

However, in this example, the sealing member 84 at the delivery section in which a large stress is applied (at the downstream side in the transporting direction of the waste toner) is made of a denser material than the material of the sealing member 82 at a section in which the stress is small (at the upstream side in the transporting direction of the waste toner). For example, the sealing member 84 includes GF felt 88. Thus, high sealing performance (tightness) is ensured in the delivery section. Accordingly, even when the waste toner accumulates in the delivery section, the waste toner may be prevented from falling out of the housing 21.

Here, only the sealing member 84 at the delivery section in which a large stress is applied (at the downstream side in the transporting direction of the waste toner) has a two-layer structure including the layers of urethane foam 86 and GF felt 88. Therefore, compared to the case in which the sealing member 82 at the section in which the stress is small (at the upstream side in the transporting direction of the waste toner) also has a two-layer structure including the layers of urethane foam 86 and GF felt 88, the manufacturing costs may be reduced.

Although the cleaning device and the image forming apparatus 10 according to the present exemplary embodiment have been explained with reference to the accompanying drawings, the cleaning device and the image forming apparatus 10 according to the present exemplary embodiment are not limited to this. For example, the present exemplary embodiment is also applicable to the case in which an intermediate transfer belt (not shown) functions as an image carrier. In this case, the rotational axis direction of each of the rollers (not shown) around which the intermediate transfer belt is wrapped serves as the rotational axis direction of the image carrier according to the present exemplary embodiment.

The sealing member 84 according to the present exemplary embodiment is particularly effective for the structure in which the waste toner easily accumulates at the downstream side in the transporting direction of the waste toner. The structure of the sealing member 84 is not limited to the illustrated two-layer structure (multilayer structure). For example, the sealing member 84 may have a single-layer structure as long as the material thereof is denser than the material of the sealing member 82. In addition, the transporting member is not limited to the screw auger 77.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member that cleans a surface of an image carrier by removing developer remaining on the surface of the image carrier instead of being transferred onto a transfer body from the surface of the image carrier;

a housing that receives the developer removed by the cleaning member;

a transporting member provided in the housing, the transporting member transporting the developer toward an end of the image carrier in a rotational axis direction;

a first sealing member that only fills a gap between a first end of the image carrier and a corresponding first end of the housing at an upstream side in a transporting direction of the developer; and a second sealing member that only fills a gap between a second end of the image carrier and a corresponding second end of the housing at a downstream side in the transporting direction of the developer, the second sealing member having a denser structure than the structure of the first sealing member.

2. The cleaning device according to claim 1, wherein the transporting member is disposed above the image carrier in the direction of gravity.

3. The cleaning device according to claim 1, wherein a transport path of the developer at the downstream side in the transporting direction of the developer crosses the transporting direction.

4. The cleaning device according to claim 2, wherein a transport path of the developer at the downstream side in the transporting direction of the developer crosses the transporting direction.

5. The cleaning device according to claim 1, further comprising:

a second transporting member that receives the developer from an end of the transporting member at the downstream side in the transporting direction of the developer and transports the developer in a substantially horizontal direction that crosses the transporting direction.

6. The cleaning device according to claim 2, further comprising:

a second transporting member that receives the developer from an end of the transporting member at the downstream side in the transporting direction of the developer and transports the developer in a substantially horizontal direction that crosses the transporting direction.

7. An image forming apparatus, comprising:

an image carrier that transfers a developer image onto a transfer body while the image carrier rotates; and the cleaning device according to claim 1, the cleaning device being in contact with a surface of the image carrier and removing developer from the surface of the image carrier, the developer remaining on the surface of the image carrier instead of being transferred onto the transfer body.

8. An image forming apparatus, comprising:

an image carrier that transfers a developer image onto a transfer body while the image carrier rotates; and the cleaning device according to claim 2, the cleaning device being in contact with a surface of the image carrier and removing developer from the surface of the image carrier, the developer remaining on the surface of the image carrier instead of being transferred onto the transfer body.

9. An image forming apparatus, comprising:

an image carrier that transfers a developer image onto a transfer body while the image carrier rotates; and the cleaning device according to claim 3, the cleaning device being in contact with a surface of the image carrier and removing developer from the surface of the image carrier, the developer remaining on the surface of the image carrier instead of being transferred onto the transfer body.

10. An image forming apparatus, comprising:

an image carrier that transfers a developer image onto a transfer body while the image carrier rotates; and the cleaning device according to claim 4, the cleaning device being in contact with a surface of the image carrier and removing developer from the surface of the image carrier, the developer remaining on the surface of the image carrier instead of being transferred onto the transfer body.

11. An image forming apparatus, comprising:

an image carrier that transfers a developer image onto a transfer body while the image carrier rotates; and the cleaning device according to claim 5, the cleaning device being in contact with a surface of the image carrier and removing developer from the surface of the image carrier, the developer remaining on the surface of the image carrier instead of being transferred onto the transfer body.

12. An image forming apparatus, comprising:

an image carrier that transfers a developer image onto a transfer body while the image carrier rotates; and the cleaning device according to claim 6, the cleaning device being in contact with a surface of the image carrier and removing developer from the surface of the image carrier, the developer remaining on the surface of the image carrier instead of being transferred onto the transfer body.

13. A cleaning method comprising:

cleaning a surface of an image carrier by removing developer from the surface of the image carrier, the developer remaining on the surface of the image carrier instead of being transferred onto a transfer body;

receiving the developer removed by the cleaning member into a housing;

transporting the developer received in the housing toward an end of the image carrier in a rotational axis direction;

filling only a gap between a first end of the image carrier and a corresponding first end of the housing at an upstream side in a transporting direction of the developer with a first sealing member; and filling only a gap between a second end of the image carrier and a corresponding second end of the housing at a downstream side in the transporting direction of the developer with a second sealing member, the second sealing member having a denser structure than the structure of the first sealing member.

14. The cleaning device according to claim 1, wherein the second sealing member comprises a layer of glass fiber.

15. The cleaning method according to claim 13, wherein the second sealing member comprises a layer of glass fiber.

* * * * *